US008055170B2

(12) United States Patent
Taniguchi

(10) Patent No.: US 8,055,170 B2
(45) Date of Patent: Nov. 8, 2011

(54) IMAGE FORMING APPARATUS WITH CLEARANCE RETAINING PORTION

(75) Inventor: Susumu Taniguchi, Osaka (JP)

(73) Assignee: Kyocera Mita Corporation (JP)

( * ) Notice: Subject to any disclaimer, the term of this patent is extended or adjusted under 35 U.S.C. 154(b) by 844 days.

(21) Appl. No.: 12/033,954

(22) Filed: Feb. 20, 2008

(65) Prior Publication Data

US 2008/0226362 A1 Sep. 18, 2008

(30) Foreign Application Priority Data

Mar. 15, 2007 (JP) ..... 2007-066374

(51) Int. Cl.
*G03G 15/16* (2006.01)

(52) U.S. Cl. ..... 399/316; 399/317; 399/388

(58) Field of Classification Search ..... 399/316, 399/317, 388
See application file for complete search history.

(56) References Cited

U.S. PATENT DOCUMENTS 6,256,472 B1 * 7/2001 Miyake et al. ..... 399/313
7,039,337 B2 * 5/2006 Kawaguchi et al. ..... 399/90
7,424,257 B2 * 9/2008 Yoo et al. ..... 399/316
7,664,445 B2 * 2/2010 Nishida et al. ..... 399/316
2005/0260015 A1 * 11/2005 Ito ..... 399/316
2007/0025786 A1 * 2/2007 Yasuhara et al. ..... 399/350

FOREIGN PATENT DOCUMENTS

JP 11-288188 10/1999

* cited by examiner

*Primary Examiner* — David Gray
*Assistant Examiner* — Geoffrey Evans
(74) *Attorney, Agent, or Firm* — Gerald E. Hespos; Michael J. Porco

(57) ABSTRACT

In an image forming apparatus, a pre-transfer guide (50) is provided immediately before a transfer nip portion formed by an intermediate transferring belt (12) and a transferring roller (18*b*). The pre-transfer guide (50) extends in a width direction of a sheet conveying path, and projections (50*b*) are formed on opposite end portions of the pre-transfer guide (50) on sides outer than an area on which a sheet is conveyed. The intermediate transferring belt (12) is driven in a state where a tension is applied to some extent, so that it may bow in a thickness direction on a running path. However, in an area immediately before the transfer nip portion, the projections (50*b*) retains a distance between the sheet and the intermediate transferring belt (12) to be greater than a predetermined distance.

6 Claims, 9 Drawing Sheets

IMAGE FORMING APPARATUS WITH CLEARANCE RETAINING PORTION

BACKGROUND OF THE INVENTION

1. Field of the Invention

The present invention relates to an image forming apparatus in which a toner image is transferred onto a sheet with use of an intermediate transferring belt.

2. Description of the Related Art

A conventional technology related to this kind of image forming apparatus has been a technology disclosed in, for example, Japanese Patent Unexamined Publication H11-288188 (referred to as a patent document 1, hereinafter). The patent document 1 discloses image forming of primarily transferring a toner image onto an intermediate transferring belt and then secondarily transferring the toner image onto a sheet. According to the patent document 1, an electrostatic latent image is formed on a surface of a photoconductive member based on image data, and the latent image is developed by a multi-color developing device for each color and primarily transferred to the intermediate transferring belt. Then, the toner images of all colors are synthesized into one color toner image, and then the color toner image is secondarily transferred from the intermediate transferring belt onto a sheet.

Further, according to the patent document 1, there is provided a guide plate at an upstream position of the transferring roller for guiding the sheet along the surface of the intermediate transferring belt. A sheet sent from a pair of registration rollers is guided by the guide plate and conveyed in a direction along the surface of the intermediate transferring belt. The guide plate ends at an upstream position upstream of the transferring roller, and the sheet is taken over by a guide of another member (a member which is integrally formed with a holder of the transferring roller) from the end (downstream) of the guide plate. Then, the sheet is guided by the guide and sent to a nip portion between the intermediate transferring belt and the transferring roller, and then the toner image is secondarily transferred onto the sheet while the sheet passes through the nip portion.

The intermediate transferring belt used in the above-described patent document 1 is normally driven (rotationally running) in a state where a tension is given to some extent. Therefore, it is likely that an oscillation (movement) with a flexure in a thickness direction on a rotational path of the belt. Such flexural oscillation of the intermediate transferring belt changes a distance between the sheet and the intermediate transferring belt in an area immediately before a nip portion between the transferring roller and the intermediate transferring belt (an upstream position in the conveying direction).

On the other hand, in the case where a sheet is conveyed in a direction along a surface of the intermediate transferring belt like the patent document 1, the sheet and the intermediate transferring belt are extremely close to each other immediately before the nip portion. At this time, if a distance between the intermediate transferring belt and the sheet becomes so small because of deformation of the intermediate transferring belt, the sheet may rub a toner image on the belt before it enters the nip portion, and a part of the toner image stuck to the belt may be dispersed on the sheet. In particular, since a rear end portion of a sheet can be freely moved after the rear end of the sheet goes out from the nip portion of the pair of registration rollers, the intermediate transferring belt is likely to come in contact with the sheet if the sheet slightly hops when the flexure occurs in the intermediate transferring belt.

In this case, even if a toner image is correctly formed, a quality of an image outputted after the secondary transfer is negatively affected.

SUMMARY OF THE INVENTION

In view of the above, an object of the present invention is to get rid of an effect to an image quality due to a flexure which occurs in an intermediate transferring belt to output a high-quality image.

In order to achieve the above-described object, an image forming apparatus according to the present invention comprises: an image forming unit for forming a toner image by developing a latent image formed on an image bearing member with toners; an intermediate transferring belt which runs in a state where the toner image formed by the image forming unit is transferred onto its surface; a transferring roller which is arranged close to the surface of the intermediate transferring belt; a sheet conveying section for conveying a sheet through a conveying path along the surface of the intermediate transferring belt and allowing the toner image to transfer onto a transfer surface of the sheet through a nip portion formed between the intermediate transferring belt and the transferring roller; and a clearance retaining section for guiding the sheet along a conveying surface provided at an upstream position of the transfer nip portion in the conveying path and retaining a clearance between the conveying surface and the intermediate transferring belt to be greater than a predetermined clearance.

Accordingly, even if flexural oscillation occurs in the intermediate transferring belt, the surface of the intermediate transferring belt does not come too close to the sheet conveyed on the conveying surface. Therefore, it can prevent rubbing of the sheet with respect to a surface of the transferring belt at an upstream position of the transfer nip portion and spreading of toners on the sheet.

These and other objects, features and advantages of the present invention will become apparent upon reading of the following detailed description along with the accompanied drawings.

DETAILED DESCRIPTION OF THE PREFERRED EMBODIMENTS

Hereinafter, a first embodiment of an image forming apparatus will be described.

Figure 1:
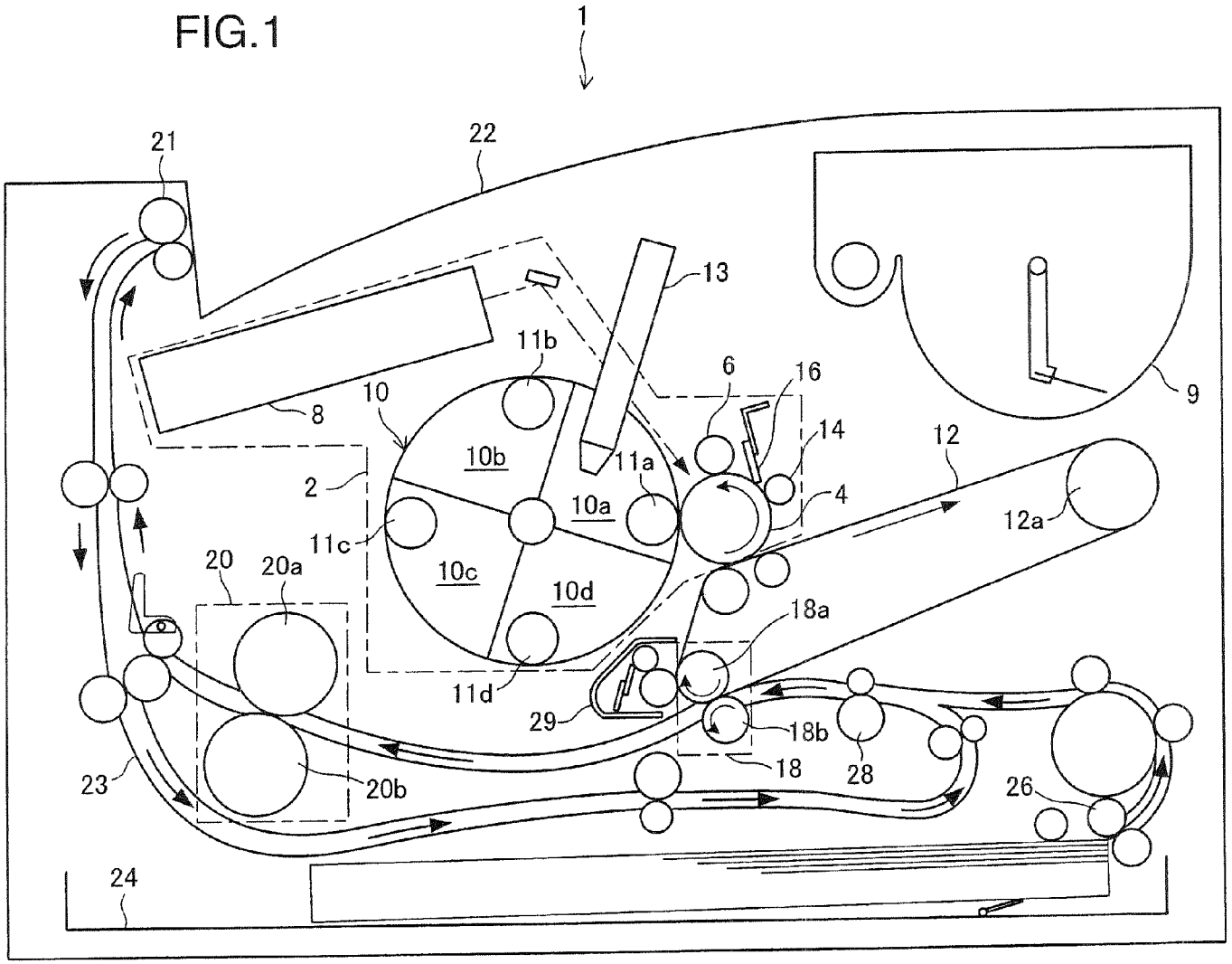
FIG. 1 is a schematic view showing a configuration example as a first embodiment of an image forming apparatus.

FIG. 1 is a schematic view showing a configuration example as a first embodiment of the image forming apparatus. In FIG. 1, the rightward direction corresponds to a front side of an image forming apparatus 1, and the leftward direction corresponds to a rear side. Thus, the leftward and rightward directions in FIG. 1 are corresponding to the frontward and rearward directions of the image forming apparatus 1. It should be understood that the schematic cross section shown in FIG. 1 corresponds to a vertical cross section of the image forming apparatus 1 viewed from a left side.

The image forming apparatus 1 includes an image forming section 2 in its main body. The image forming section 2 mainly has a photoconductive drum 4, a charging device 6, a laser scanning unit 8 and a developing unit 10.

The photoconductive drum 4 has a main body which includes a drum-like member of a rotation type, and a photoconductive member layer of, for example, an amorphous silicon is formed on an outer peripheral surface of the photoconductive drum 4. The photoconductive drum 4 is rotated in a counter-clockwise direction in FIG. 1, and this rotation causes the photoconductive drum 4 to perform on its outer peripheral surface a series of operations such as forming an electrostatic latent image, developing with use of toners, and a primary transfer of the toner image.

In a periphery of the photoconductive drum 4, the charging device 6 is provided close to an upper position of the photoconductive drum 4. The charging device 6 charges the outer peripheral surface of the photoconductive drum 4. In a state where the photoconductive drum 4 is charged, a scanning light as an image signal is irradiated from the laser scanning unit 8 toward the outer peripheral surface. At this time, a position to which the scanning light is irradiated is at downstream of the charging device 6 in a rotational direction of the photoconductive drum 4.

The laser scanning unit 8 reflects the laser light while rotating, for example, a polygon mirror at a high speed, and reflects on a flat mirror the laser light (scanning light) scanned in an axial direction of the photoconductive drum 4 to allow the outer peripheral surface of the photoconductive drum 4 to be exposed to the laser light. This allows an electrostatic latent image to be formed on the outer peripheral surface of the photoconductive drum 4.

The developing unit 10 is arranged closely to the outer peripheral surface of the photoconductive drum 4 on downstream of the irradiating position of the scanning light in the rotational direction of the photoconductive drum 4. The developing unit 10 develops an electrostatic latent image in a rotary method with use of toners of four colors (for example, magenta, cyan, yellow, black). Therefore, the developing unit 10 is also configured as to be rotatable and has four developing equipments 10*a*, 10*b*, 10*c*, 10*d* which are sectionalized for respective colors in a rotational direction. Each of the developing equipments 10*a* through 10*d* accommodates toners. Further, the developing equipments 10*a* through 10*d* have developing rollers 11*a* through 11*d*, respectively, each of which rotates while bearing toners on a respective outer peripheral surface.

Further, a toner container 9 is provided in the image forming apparatus 1, and toners for respective colors are supplied to the developing equipments 10*a* through 10*d* through a feed pipe 13. In the present embodiment, an unillustrated toner amount sensor detects toner amount of each of the developing equipments 10*a* through 10*d*, and toners are fed to retain a constant toner amount.

The developing unit 10 of a rotary type rotates and stops in such a manner that one of the developing equipments 10*a* through 10*d* which corresponds to a color to be developed faces the outer peripheral surface of the photoconductive drum 4. In a corresponding one of the developing equipments 10*a* through 10*d*, a respective one of the developing rollers 11*a* through 11*d* rotates while bearing a thin layer of toners on its outer peripheral surface, and a developing bias voltage including an AC-component and a DC-component is applied to one of the developing rollers 11*a* through 11*d*. This developing bias allows toners bore on the developing rollers 11*a* through 11*d* to be moved to an electrostatic latent image formed on the photoconductive drum 4 so that the electrostatic latent image is developed with toners of respective colors, and then a toner image as a visible image is formed on the outer peripheral surface of the photoconductive drum 4.

At a position under the photoconductive drum 4, an endless intermediate transferring belt 12 is arranged. The intermediate transferring belt 12 may be configured by, for example, a belt which is formed by superimposing and joining respective end portions of sheet members made of a dielectric resin, or a belt having no joints (seamless). The intermediate transferring belt 12 passes through a position in contact with the outer peripheral surface and runs in a rotational direction while being in synchronization with rotation of the photoconductive drum 4. The toner image formed on the photoconductive drum 4 is primarily transferred from the outer peripheral surface to the surface of the intermediate transferring belt 12 in accordance with rotation of the photoconductive drum 4.

In a periphery of the photoconductive drum 4, a slide-rubbing member 14 and a cleaning member 16 are arranged along the outer peripheral surface. The slide-rubbing member 14 and the cleaning member 16 are positioned on downstream of a position where the photoconductive drum 4 is in contact with the intermediate transferring belt 12 and on upstream of the charging device 6 in a rotational direction of the photoconductive drum 4. The slide-rubbing member 14 polishes the outer peripheral surface of the photoconductive drum 4 onto which the toner image is primarily transferred, so that an oxidized product attached to a layer of an amorphous silicon photoconductive member is removed. Further, the cleaning member 16 removes toners remaining on the outer peripheral surface of the photoconductive drum 4 and cleans the outer peripheral surface before next image forming is performed.

At a time of forming a full color image, electrostatic latent images for respective colors are formed on the photoconductive drum 4, and toner images developed by the developing unit 10 for respective colors are primarily transferred onto the intermediate transferring belt 12 in superimposition with each other, so that a color image for one page is synthesized.

The intermediate transferring belt 12 is wound around a driving roller 18*a* and a tension roller 12*a*, and a primary transfer position close to the photoconductive drum 4 is provided therebetween. The driving roller 18*a* is arranged en-upstream of the primary transfer position in a rotational direction of the intermediate transferring belt 12, and the tension roller 12*a* is arranged en-downstream. Further, the tension roller 12*a* applies an appropriate amount of tension to the intermediate transferring belt 12 with use of a repulsive force of, for example, an unillustrated spring.

At one end portion of the intermediate transferring belt 12, a transferring section 18 is provided. The transferring section 18 is provided with a transferring roller 18*b*. The transferring roller 18*b* is rotated in pair with the above-described driving roller 18*a* over the intermediate transferring belt 12. Therefore, in the transferring section 18, there is formed a transfer nip portion between the intermediate transferring belt 12 and the transferring roller 18*b*. A sheet passes through the transfer nip portion, so that a full-color toner image for one page is secondarily transferred from the intermediate transferring belt 12 to the sheet.

FIG. 1 shows arrows indicating a conveying direction of a sheet, and a fixing section 20 is provided on downstream of the transferring section 18 in the sheet conveying direction. The sheet onto which a toner image is secondarily transferred is heated and pressed in the fixing section when it passes through the nip portion between the heating roller 20*a* and the pressing roller 20*b*. This fixes the toner image onto the sheet. Thereafter, the sheet is conveyed in an upward direction at a rear end portion in the apparatus, and then discharged to the sheet-discharging tray 22 through the sheet-discharging roller 21.

In a case of forming images on both sides of a sheet, a part of the sheet which passes through the fixing section 20 once projects outward from the apparatus through the sheet-discharging roller 21. Thereafter, the sheet is taken into the apparatus again by a reverse rotation of the sheet-discharging roller 21, and then conveyed to the front surface side through a sheet reversing passage 23. Then, the sheet is conveyed to the transferring section 18 again, and a toner image corresponding to the other surface is secondarily transferred to the sheet. Thereafter, the toner image is fixed on the other surface of the sheet at the fixing section 20, and then discharged to the sheet-discharging tray 22.

The sheet onto which the toner image is transferred is accommodated in the sheet-supplying cassette 24 in a lower portion of the apparatus in a stacked state. The sheet is taken one after another from an upper most position of the stack and then conveyed to the transferring section 18 through the sheet-feeding roller 26 and the registration roller 28. The registration roller 28 once stops in a state of retaining the sheet, corrects inclination and skew of the sheet, and then sends out the sheet at a timing in synchronization with running of the intermediate transferring belt 12. This allows the toner image for one page to be accurately transferred to a prescribed position of the sheet. There is provided a cleaning unit 29 near the transferring section 18, and the cleaning unit 29 removes remaining toners attached to the intermediate transferring belt 12 after the toner image is transferred.

The basic configuration of the image forming apparatus 1 and its image forming operation are described above. In FIG. 1, an example of the image forming apparatus 1 which is configured as a color printer is shown. However, the image forming apparatus 1 of the present embodiment may be configured as a color copying machine and a color complex machine. In cases of those, the image forming apparatus 1 may have an image reading section in addition to the image forming section 2. The image reading section is provided with a scanning optical system in which, for example, a scanner lamp and a mirror are mounted, and an optical device such as a collective lens and a CCD are internally provided. Further, the image reading section may be so configured that a document automatic conveying mechanism (ADF) is mounted as an attachment.

Figure 2:
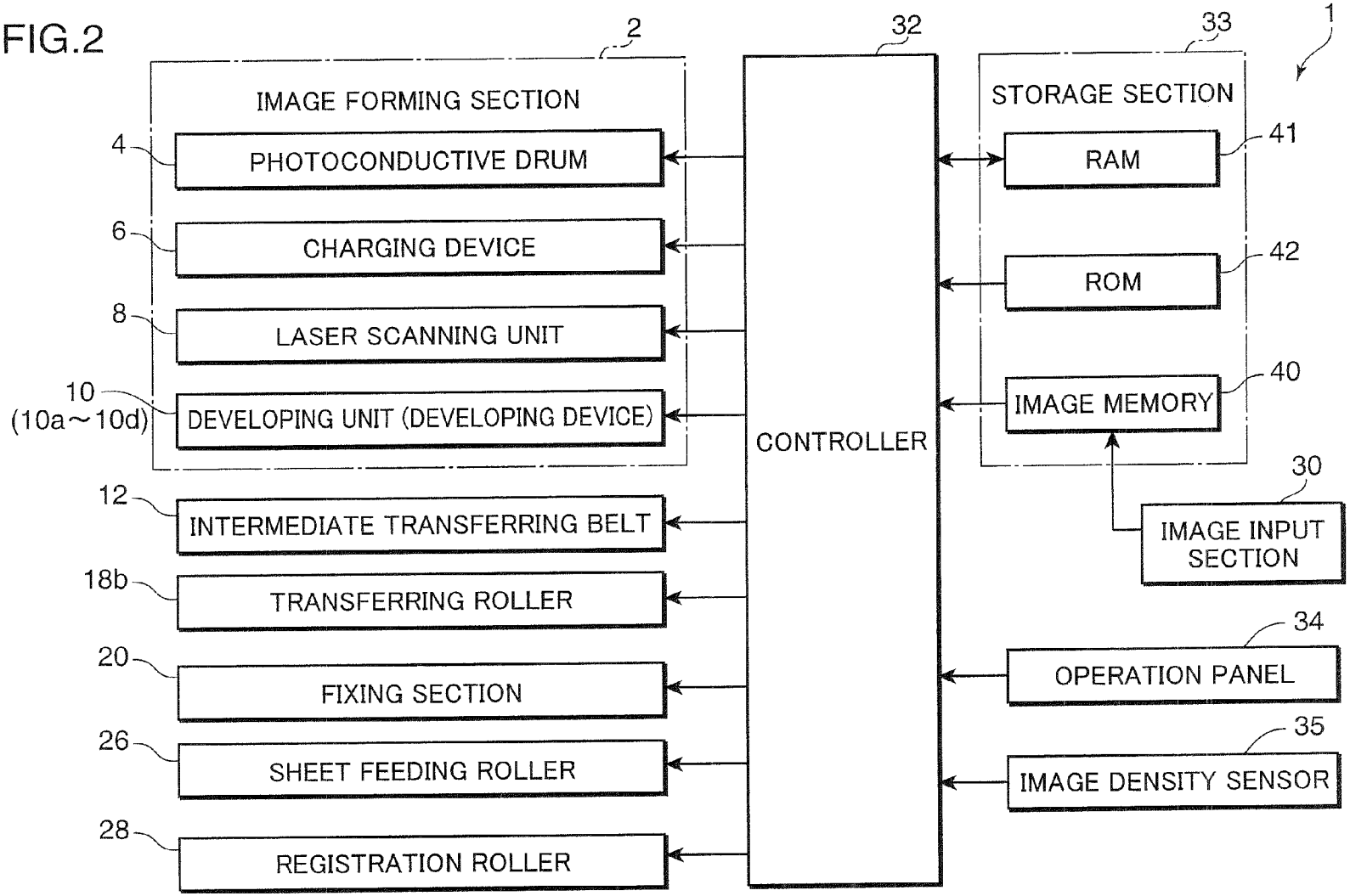
FIG. 2 is a block diagram showing a configuration related to a control of the image forming apparatus.

FIG. 2 is a block diagram showing a configuration related to a control of the image forming apparatus 1. As described above, the image forming apparatus 1 is provided with the image forming section 2, the intermediate transferring belt 12, the fixing section 20, the sheet feeding 26, and the registration roller 28. Further, the image forming apparatus 1 is provided with an image input section 30, a controller 32, a storage section 33, an operation panel 34, and the like as controlling elements.

The image input section 30 is configured as a receiving section for receiving image data (a group of image data for all pages) transmitted from, for example, an personal computer. In a case where the image forming apparatus 1 is a copying machine or a complex machine, the image input section 30 is configured by a scanning optical system which includes a scanner lamp for illuminating a document at a time of copying and a mirror for changing a light path of a light reflected from a document, a collective lens for collecting the reflected light from the document and forming an image, and a CCD for converting the formed image light to an electric signal. The image signal inputted to the image input section 30 is applied with a signal processing (P/S conversion, A/D conversion, or the like) when necessary, and thereafter transferred to an image memory 40 in the storage section 33.

The storage section 33 is provided with the image memory 40, a RAM 41, and a ROM 42. Among those, the image memory 40 is a buffer which is adapted to store an image signal transferred from the image input section 30 and transfer the same to the controller 32. The RAM 41 and the ROM 42 stores a processing program and a processing content of the control section, and further stores a set value and the like for a developing bias applied to the developing unit 10.

The operation panel 34 includes an operating section having a plurality of operation keys and a display portion for displaying settings and a status of the apparatus (any of those are not shown). It is favorable that a display portion be a liquid crystal display, and the display portion may be a touch panel which receives an operation through its display screen. Such operation panel 34 is provided on an exterior cover surface of the image forming apparatus 1 to receive settings such as a print setting inputted by a user through the operation keys. Further, for example, in a case where the image forming apparatus 1 has a facsimile function, the operation panel 34 may be used for registering facsimile addressees to the storage section 33, and further used for conducting various settings such reading and re-writing the registered addressees.

Driving sections including the photoconductive drum 4, the developing unit 10, the intermediate transferring belt 12, the transferring roller 18*b*, and the fixing section 20 are driven by a main motor which is not illustrated. The controller 32 has a function of controlling rotation of the main motor to allow the various driving portions to be operated appropriately. In a case of driving or stopping only any one of the driving portions, a clutch mechanism (not shown) provided between the main motor and a respective driving portion is connected or disconnected. It may be so configured that a motor for exclusive use is connected to each of the driving portions so that each unit is driven independently from other units.

Further, the controller 32 is connected with an image density sensor 15 (not shown in FIG. 1), and the image density sensor 15 inputs a density detection signal of a toner image formed on the intermediate transferring belt 12. The image density sensor 15 detects an image density of a patch formed at a time when a calibration is performed, and its is used when a density adjustment is performed.

Furthermore, the controller 32 is connected with a drive motor (not shown) for performing feeding of a sheet and conveying and discharging of a sheet onto which an image is transferred, and the controller 32 sends a control signal to the drive motor. The controller 32 controls a rotational state of the drive motor, so that respective rotations of the sheet-feeding roller 26, the registration roller 28, and the sheet-discharging roller 21 (not shown in FIG. 2) are controlled.

Furthermore, the controller 32 generally controls the image input section 30, the image forming section 2, and the fixing section 20 in accordance with a set program, and it converts an image signal inputted from the image input section 30 to image data and executes a magnification processing or a gradation processing when necessary. The converted image data includes four image signals for respective colors of magenta, cyan, yellow, and black to form a color image. The image signal for respective colors are transmitted in a certain order to a laser scanning unit 8 of the image forming section 2. The laser scanning unit 8 generates a pulse laser light in accordance with the image signal transmitted from the controller 32 and irradiates the pulse laser light to the outer peripheral surface of the photoconductive drum 4 while reflecting the same on a polygon mirror.

On the other hand, the image forming section 2 sends synchronizing signals individually (for respective colors) to the controller 32. The synchronizing signals are used for synchronizing timings that the controller 32 transmits image signals for respective colors. When developing of an image is performed by each of the developing equipments 10*a* through 10*d* in the developing unit 10, the synchronizing signals are sent sequentially from an image forming controller. Then, when the controller 32 receives synchronizing signals for respective colors, image signals for respective colors are transmitted to the image forming section in the order of reception.

The image forming control executed in the image forming apparatus 1 is generally described above. In accordance with the image forming control of the present embodiment, forming of a high-quality toner image is performed based on image data. However, even if an appropriate control is performed to form a toner image, a belt surface may be rubbed with a sheet to affect a quality of an outputted image as described above when a flexural oscillation (movement) occurs in the intermediate transferring belt 12 immediately before a transfer nip portion of the transferring section 18. Therefore, in the present embodiment, the following configuration is applied to maintain a high quality image.

Figure 3:
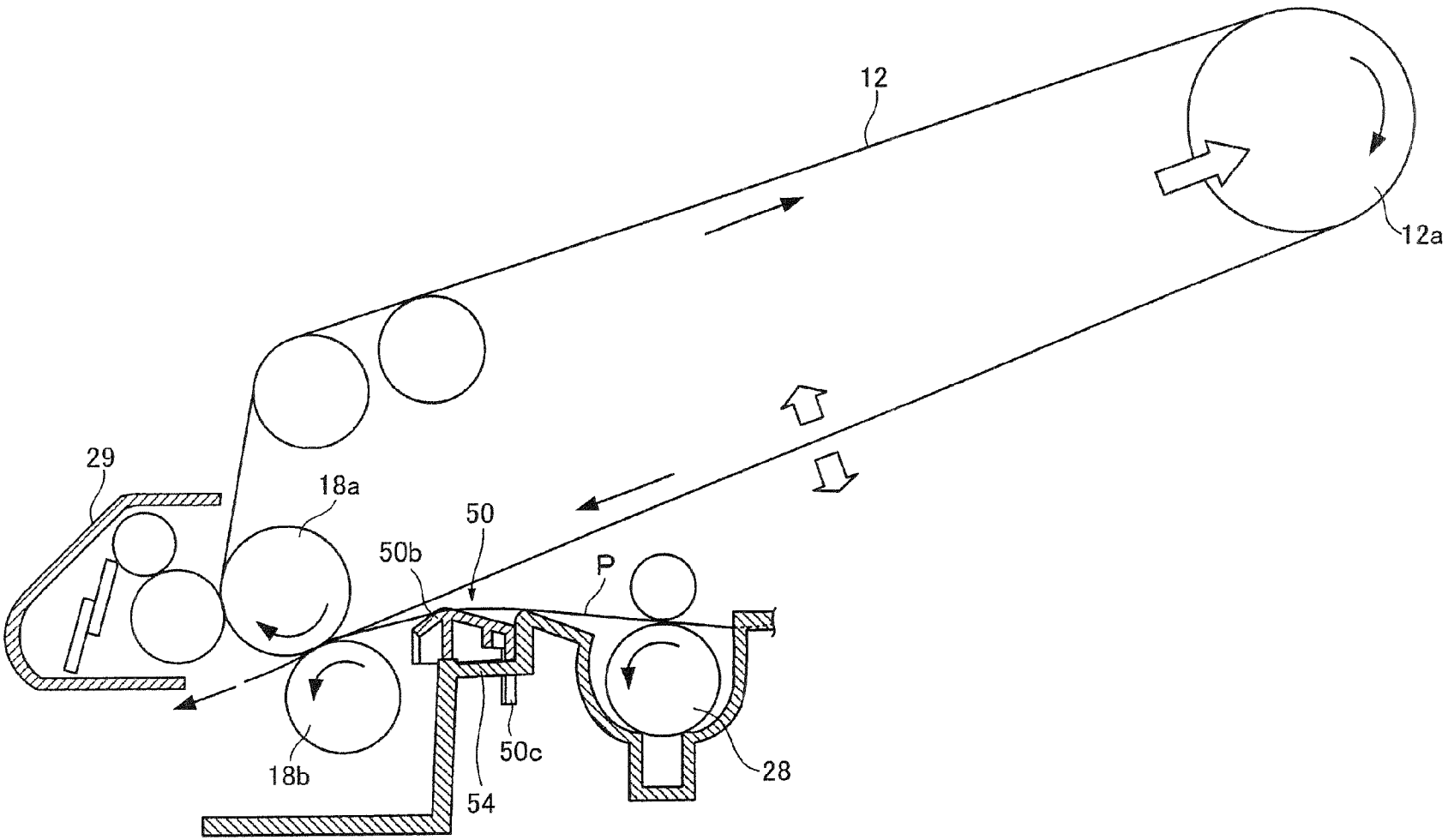
FIG. 3 is an enlarged view showing a transferring section provided in the image forming apparatus and its vicinity.

FIG. 3 is an enlarged view showing the transferring section 18 and its vicinity in the image forming apparatus 1. As described above, an adequate tensional force is applied to the intermediate transferring belt 12 in a circumferential direction by a biasing force (an outline arrow in FIG. 3) of a tension roller 12*a*. It is known that a movement (a vibration in a thickness direction) as indicated by outline arrows in FIG. 3 is likely to occur when the intermediate transferring belt 12 is driven in such state.

In the present embodiment, a pre-transfer guide 50 (guide member) according to a first embodiment is provided immediately before a transfer nip portion between the intermediate transferring belt 12 and the transferring roller 18*b*, so that a distance (clearance) between the intermediate transferring belt 12 and a sheet (identified by a reference sign P) conveying is retained to be greater than a predetermined amount at a position immediately before the transfer nip portion. Hereinafter, the pre-transfer guide 50 according to the first embodiment will be described in detail.

Figure 4:
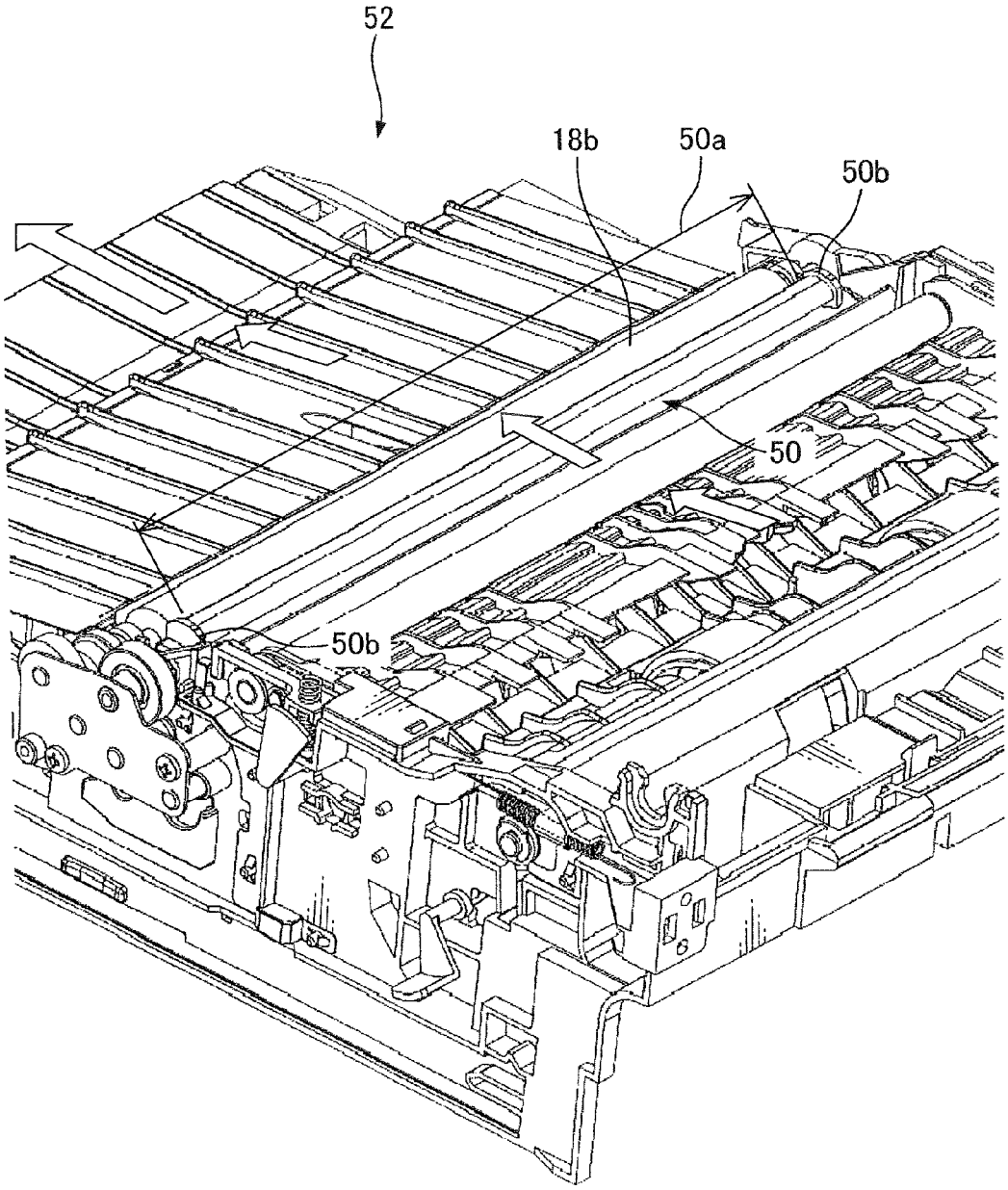
FIG. 4 is a perspective view showing a part of a conveying unit provided in an apparatus main body.

FIG. 4 is a perspective view showing a part of a conveying unit 52 provided in the apparatus main body. In the apparatus, the intermediate transferring belt 12 is so arranged as to cover an upper surface of the conveying unit 52. The conveying unit 52 is adapted to convey a sheet mainly in front and rear (upstream and downstream) of the transferring section 18, and a sheet conveying path is formed on its upper surface as indicated by the outline arrows in FIG. 4. Further, on the upper surface of the conveying unit 52, the above-described transferring roller 18*b* and pre-transfer guide 50 are shown exposedly. It should be understood that the lower oblique right side in FIG. 4 corresponds to a front surface side, the right hand position in FIG. 1, of the apparatus main body, and the upper oblique left side in FIG. 4 corresponds to a rear surface side, the left hand position in FIG. 1, of the apparatus main body.

As shown in FIG. 4, the pre-transfer guide 50 extends in a width direction of the conveying path, and its entire length is longer than that of a sheet conveying area (sheet width). On an upper surface of the pre-transfer guide 50, a conveying surface 50*a* is formed. The conveying surface 50*a* is as wide as or slightly wider than the sheet conveying area. Further, the pre-transfer guide 50 includes projections 50*b* which are integrally formed on outer sides (opposite sides) in the width direction of the conveyance path of the conveying surface 50*a*. The projections 50*b* are so shaped as to project upward from the conveying surface 50*a*, and their respective upper ends are positioned higher than the conveying surface 50*a*.

Figure 5A:
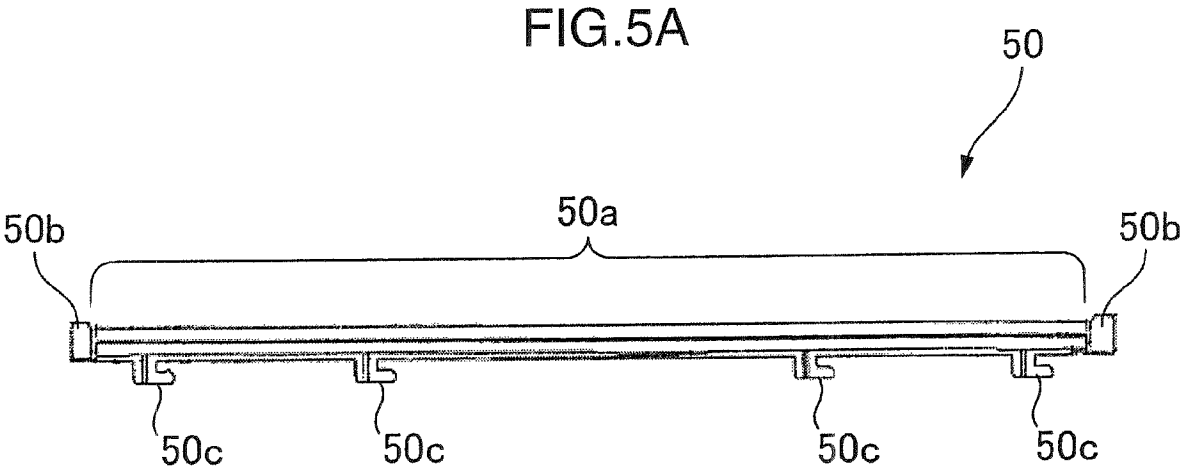
FIGS. 5A to 5C, each shows a single piece of a pre-transfer guide from a different angle.
Figure 5C:
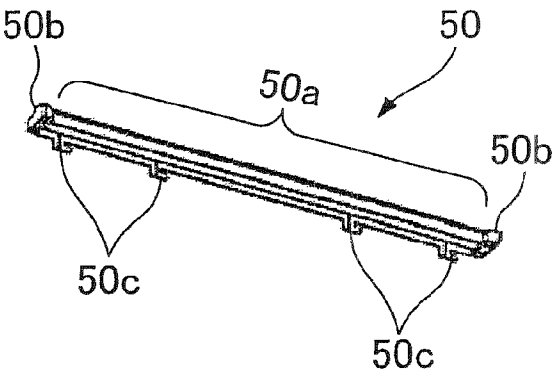
Figure 5B:
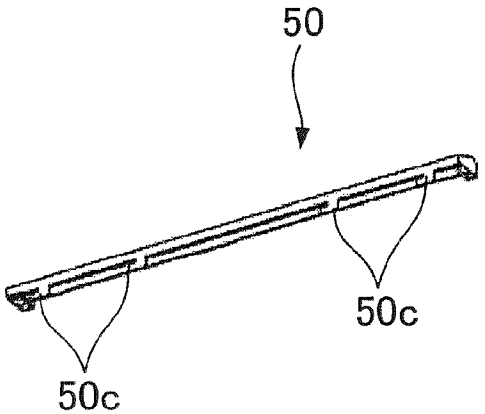

FIG. 5A to FIG. 5C, each shows the pre-transfer guide 50 viewed from different directions. FIG. 5A is a front view of the pre-transfer guide 50. FIG. 5B is a rear perspective view of the pre-transfer guide 50. FIG. 5C is a front perspective view of the pre-transfer guide 50.

In a lower portion of the pre-transfer guide 50, four hooking claws 50*c* are formed in a longitudinal direction at intervals. Each of the hooking claws 50*c* has a base end portion which slightly hangs downwardly from the pre-transfer guide 50 and bends in a longitudinal direction toward a leading end, so that it has an L-shape. The pre-transfer guide 50 is detachably supported by hooking the hooking claws 50*c* to the conveying unit 52.

Figure 6:
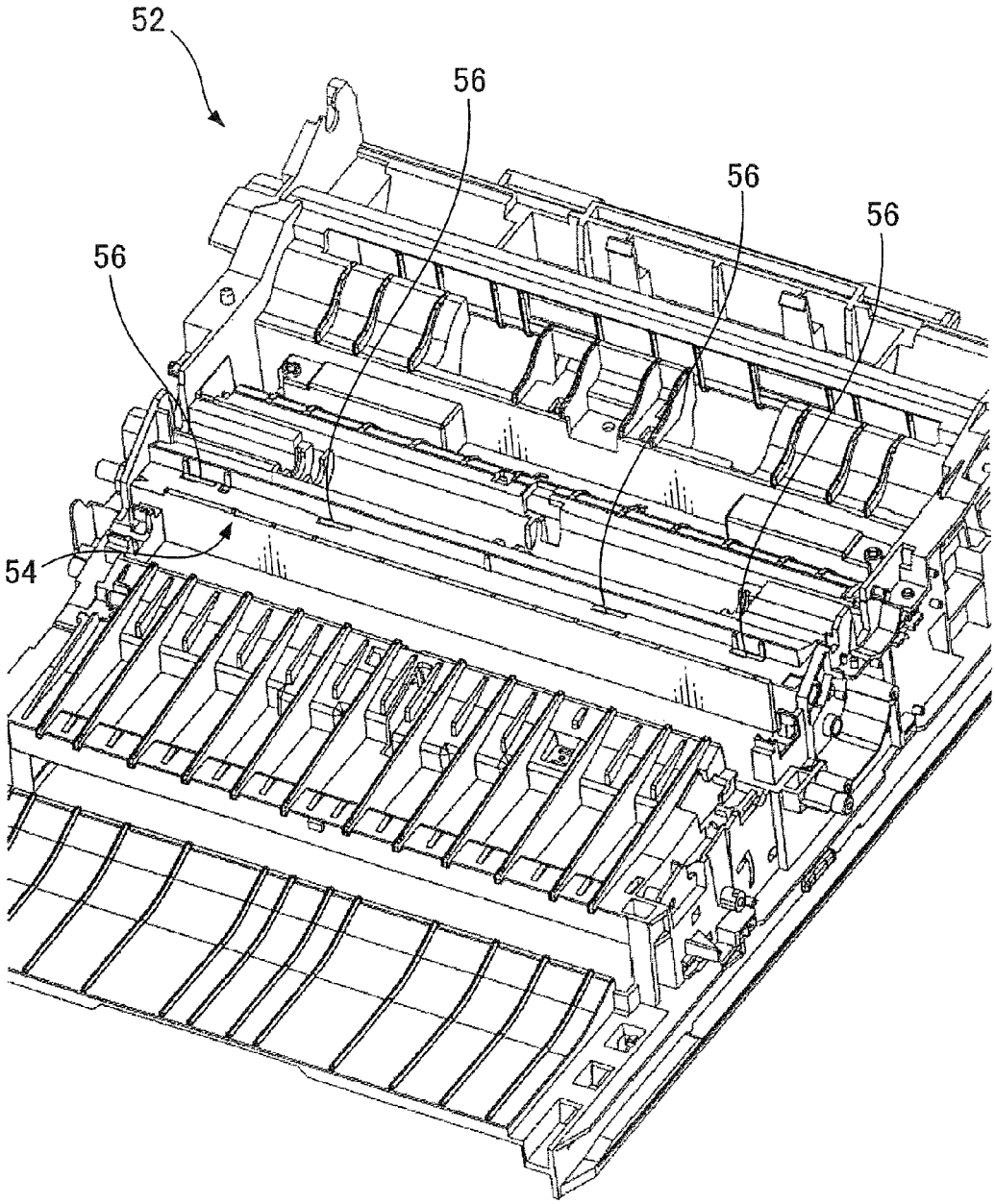
FIG. 6 is a perspective view showing a part of the conveying unit which is viewed from a direction different from that of FIG. 4.

FIG. 6 is a perspective view showing a part of the conveying unit 52 which is viewed from a direction different from that of FIG. 4. The upper oblique right side in FIG. 6 corresponds to the front surface side, the right hand side in FIG. 1, of the apparatus main body, and the lower oblique left side in FIG. 6 corresponds to the rear surface side, the left hand side in FIG. 1, of the apparatus main body. FIG. 6 shows a state where the pre-transfer guide 50 is detached from the conveying unit 52 is shown.

In a part of the conveying unit 52, there is formed a plate-like supporting plate 54. The supporting plate 54 extends in a width direction of the conveying path like the pre-transfer guide 50, and its upper surface is so formed as to be a flat surface. Further, in the supporting plate 54, there are formed four hooking holes 56 which are open on the upper surface. The hooking holes 56 are formed through the supporting plate 54 in a thickness direction, and each of those has a shape which is elongated in a width direction of the conveying path when viewed from the upper surface.

Figure 7A:
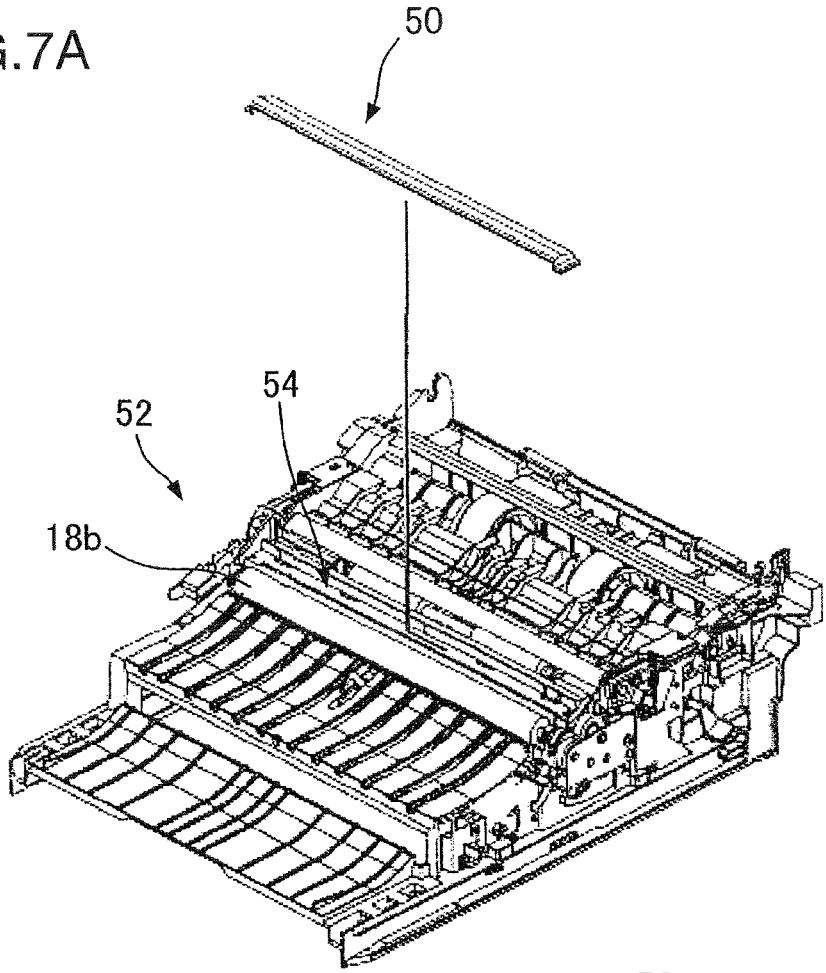
FIGS. 7A to 7C are a perspective view and a partial enlarged view specifically showing an attaching and detaching structure of the pre-transfer guide.
Figure 7B:
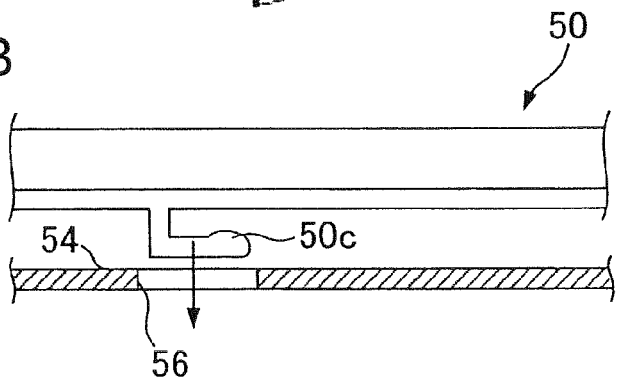
Figure 7C:
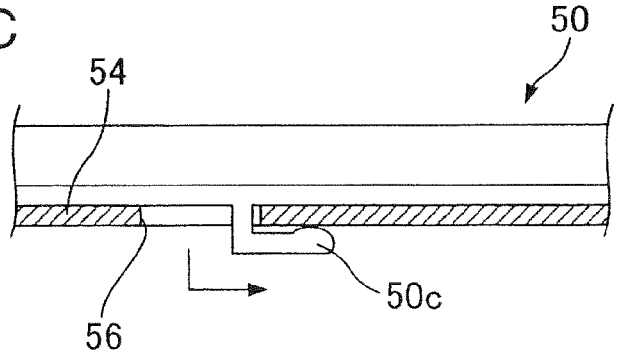

Next, FIGS. 7A to 7C are a perspective view and a partial enlarged view specifically showing an attaching and detaching structure of the pre-transfer guide 50. The attaching and detaching structure of the pre-transfer guide 50 is realized with use of, for example, the hooking claw 50*c*, the supporting plate 54, and the hooking holes 56.

As shown in FIG. 7A, firstly, the pre-transfer guide 50 is attached at an upper position of the supporting plate 54 when the pre-transfer guide 50 is attached to the conveying unit 52.

Next, as shown in FIG. 7B, the four hooking claws 50*c* are so arranged as to be positioned at the hooking holes 56 corresponding respectively, and then inserted downwardly. At this time, the lower surface of the pre-transfer guide 50 comes in close contact with the upper surface of the supporting plate 54.

Then, as shown in FIG. 7C, the pre-transfer guide 50 is slid in a longitudinal direction, and the hooking claws 50*c* are hooked to the supporting plate 54. In particular, respective leading end portions of the hooking claws 50*c* are slid in the lower surface side of the supporting plate 54, so that the lower surface of the pre-transfer guide 50 and the respective leading end portions of the hooking claws 50*c* nip the supporting plate 54 and are fixed thereon. At this time, each of the hooking claws 50*c* positions the pre-transfer guide 50 at a position where its base end portion comes in contact with a respective end of the hooking hole 56.

Further, for example, in the case of replacing the pre-transfer guide 50 as a wear-out part, the pre-transfer guide 50 can be detached in the reverse procedure. The supporting plate 54 and the hooking claws 50*c* should be referred to FIG. 3 appropriately.

Next, a function of the intermediate transferring belt 12 will be described in detail.

Figure 8A:
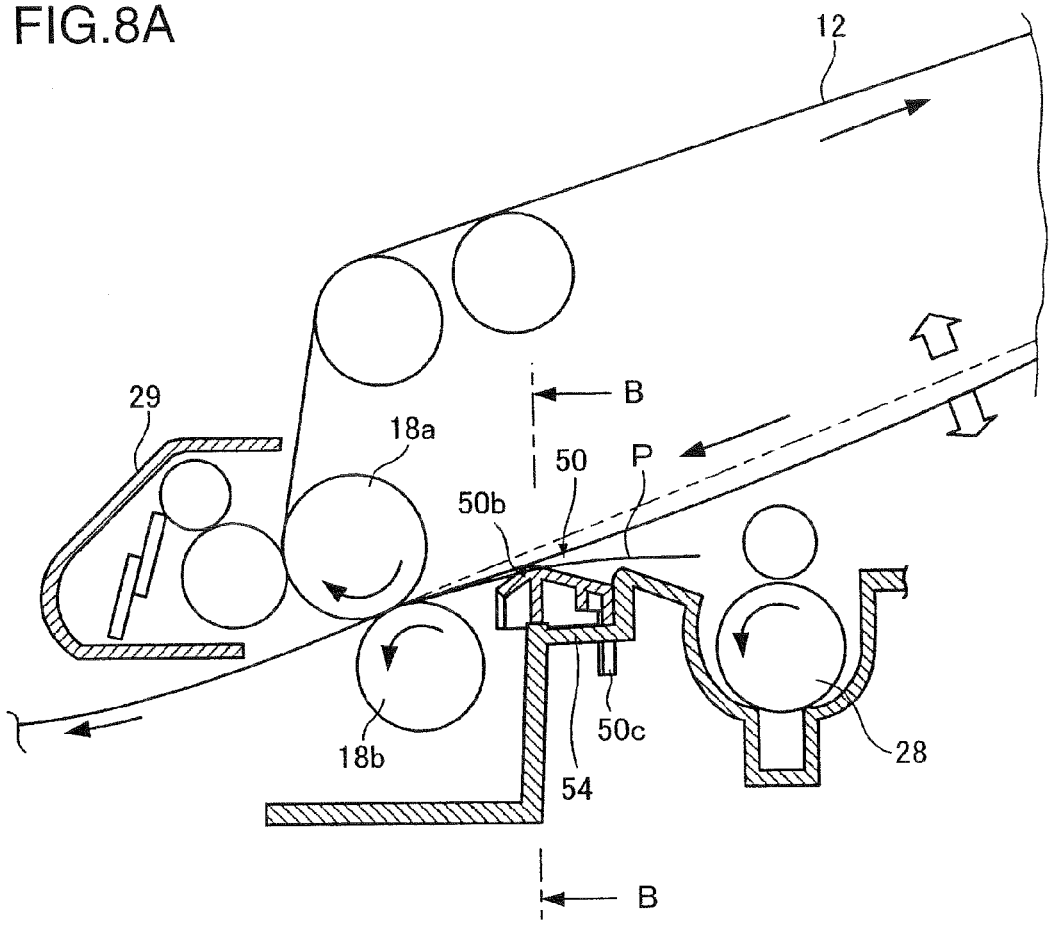
FIGS. 8A and 8B show sectional views of the intermediate transferring belt and the pre-transfer guide.
Figure 8B:
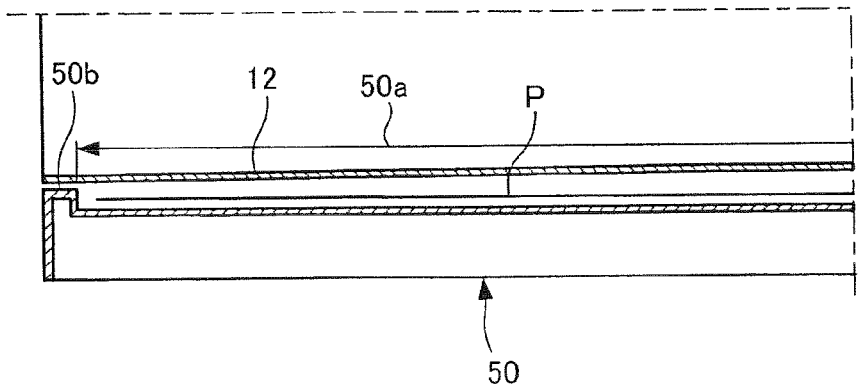

FIG. 8A and FIG. 8B show sectional views of the intermediate transferring belt 12 and the pre-transfer guide 50. FIG. 8A shows a cross section which is same as that of FIG. 3, and its cross section taken along B-B is shown in FIG. 8B.

FIG. 8A shows a case where a flexure occurs due to driving of the intermediate transferring belt 12. In this case, the intermediate transferring belt 12 bows downward at a position immediately before the transfer nip portion, and the surface on which a toner image is formed comes close to the sheet (reference sign P).

Even in this case, since the projections 50*b* of the pre-transfer guide 50 are formed on the outer side of the area on which the sheet is conveyed as shown in FIG. 8B, a distance between the surface of the intermediate transferring belt 12 and the conveying surface 50*a* is retained to be equal to or greater than a height of the projections 50*b*. Further, for example, even if a rear end of the sheet becomes free after getting out of the nip portion of the registration roller 28, and the rear end portion of the sheet is slightly lifted up from the conveying surface 50*a*, the intermediate transferring belt 12 does not bow to be lower than the projection 50*b*, so that a contact with respect to the sheet can be assuredly prevented. This prevents a sheet from rubbing the surface of the intermediate transferring belt 12 at a position immediately before the transfer nip portion and prevents toners from spreading on the sheet, so that a high-quality toner image can be transferred to the sheet.

Figure 9:
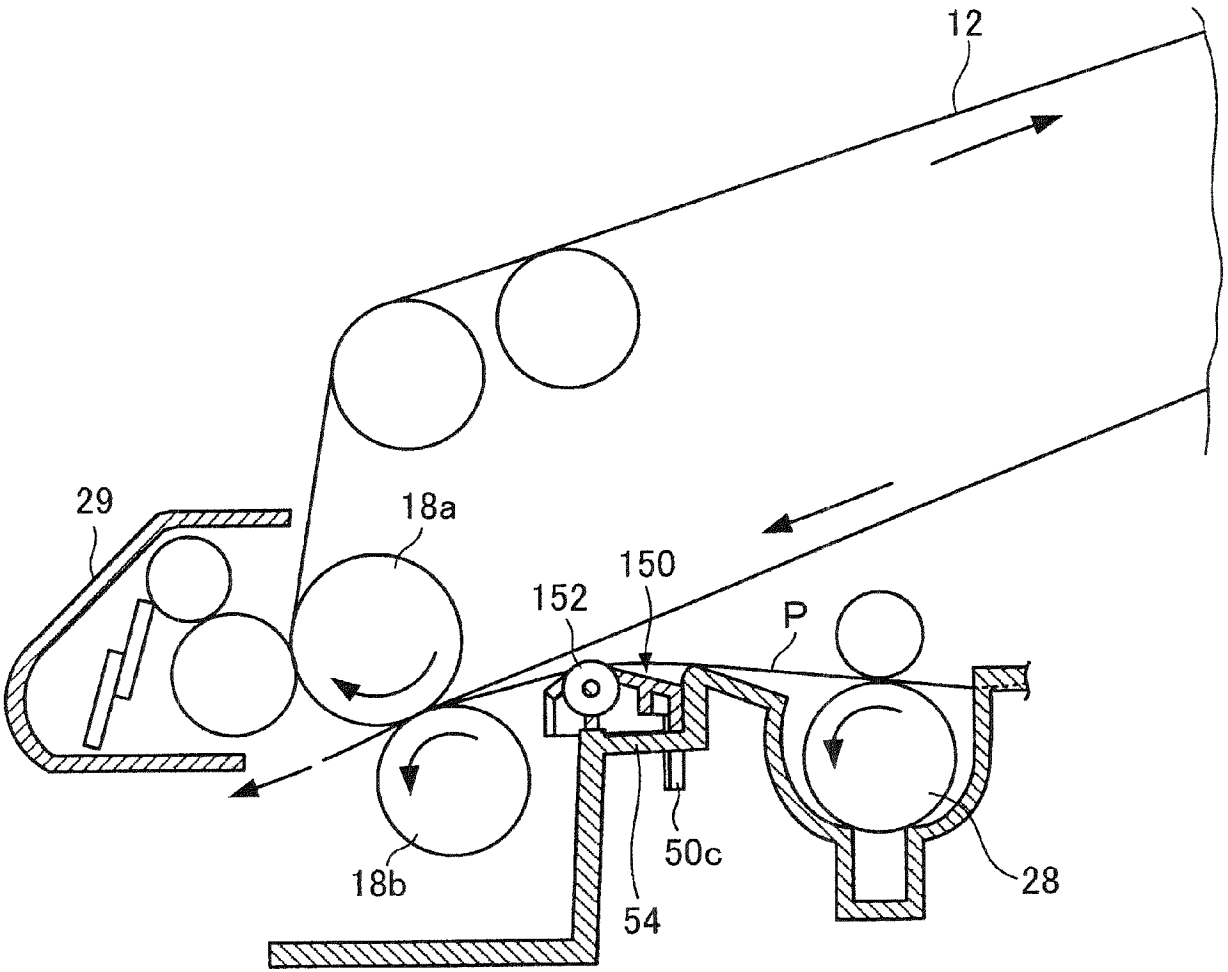
FIG. 9 shows a pre-transfer guide according to a second embodiment.

FIG. 9 shows a pre-transfer guide 150 according to a second embodiment. The pre-transfer guide 150 according to the second embodiment has guide rollers 152 in place of the projections 50*b* of the first embodiment. The guide roller 152 is provided on outer sides of the area on which the sheet is conveyed, like the projection 50*b* of the first embodiment, and is supported freely rotatably at this position.

According to the pre-transfer guide 150 of the second embodiment, when the intermediate transferring belt 12 bows downward greatly, and its surface comes in contact with the guide roller 152, the guide roller 152 is rotated by running of the intermediate transferring belt 12. This softens a friction with respect to the intermediate transferring belt 12.

The present invention is not limited to the first embodiment described above, and it may be changed variously and practiced.

In the pre-transfer guides 50, 150 of the first and second embodiments, the projections 50*b* or the guide rollers 152 are provided on opposite sides of the conveying surface 50*a*. However, it may be provided only on one side. Alternatively, the projection 50*b* shown in the first embodiment may be provided on one side, and the guide roller 152 may be provided on the other side.

In the first embodiment, an example is shown where an angle between the sheet conveying path and the intermediate transferring belt 12 is relatively small. However, for example, the present invention may be applied to the configuration where the sheet conveying path extends in a lengthwise direction and the intermediate transferring belt extends in a widthwise direction.

In the first embodiment, the developing unit of a rotary type is shown as an example. However, a developing unit may be of a tandem type. Further, an image forming apparatus of a full-color type is shown in the first embodiment. However, the image forming apparatus may be of a monochromatic type.

In summary, an image forming apparatus according to the present invention has a configuration of primarily transferring a toner formed by the image forming unit to the intermediate transferring belt and secondarily transferring the toner image from the intermediate transferring belt to a sheet. The image forming unit is adapted to form a toner image by developing a latent image formed on an image bearing member with toners. The intermediate transferring belt runs in a state where the toner image formed by the image forming unit is transferred on its surface.

A transferring roller is arranged close to the surface of the intermediate transferring belt, and a transfer nip portion is formed between the transferring roller and the intermediate transferring belt. The sheet is conveyed through a conveying path along the surface of the intermediate transferring belt, and passes through the transfer nip so that the toner image is secondarily transferred on the sheet.

In particular, the present invention is provided with a function of retaining a clearance between a conveying surface, which is adapted to guide a sheet at an upstream position before a sheet conveyed through the conveying path reaches the transfer nip portion, and the surface of the intermediate transferring belt to be greater than a predetermined clearance. This prevents the surface of the intermediate transferring belt from coming too close to the sheet guided on the conveying surface even if a flexural oscillation occurs in the intermediate transferring belt, so that rubbing of a sheet with respect to the surface of the transfer belt at an upstream position of the transfer nip and dispersing of toners on the sheet can be prevented.

As a configuration for realizing the function of retaining the clearance to be greater than the predetermined clearance as described above, the present invention is provided with a projection on an outer side of a passing area of the sheet in a width direction of the conveying path. This projection is so configured as to project toward the surface of the intermediate transferring belt from the conveying surface of the conveying path.

In this case, a clearance between the conveying surface and the surface of the intermediate transferring belt can be retained to be greater than a predetermined clearance through the above-described projection, so that a contact between the conveying surface and the surface of the intermediate transferring belt can be prevented by the projection even if the flexure causes the surface of the intermediate transferring belt to come close to the sheet on the conveying surface.

Alternatively, as a more practical configuration, a guide member is provided at an upstream position of the transfer nip portion in the sheet conveying. This guide member has a conveying surface which extends in a width direction of the conveying path at an upstream position of the transfer nip portion to guide the sheet along the conveying surface. The guide member is integrally formed with the above-described projection. In this case, the projection is so configured as to project toward a surface of the intermediate transferring belt from the conveying surface at a position outer than a sheet passing area on the conveying surface.

In this case, the guide member can retain the clearance between the conveying surface and the surface of the intermediate transferring belt to be greater than a predetermined clearance through the projection, so that a contact between the surfaces can be prevented by the projection even if the flexure causes the surface of the intermediate transferring belt to come close to the sheet on the conveying surface.

Further, the present invention may be further provided with an attaching and detaching structure for detachably supporting the guide member with respect to the conveying path. In this case, even if the guide member is used up due to abrasion or the like, it can be easily replaced.

Further, according to the present invention, a guide roller can be used in place of the above-described projection. The guide roller is provided on an outer side of a passage area of the sheet in a width direction of the conveying path and rotatably supported at such a position that the summit of the circumference surface of the guide roller is closer to the surface of the intermediate transferring belt than the conveying path (conveying surface). Further, the guide roller may be provided on the guide member in place of the above-described projection.

In this case, a clearance between the conveying surface and the surface of the intermediate transferring belt can be retained to be greater than a predetermined clearance through the guide roller, so that a contact between the sheet on the conveying surface and the intermediate transferring belt can be assuredly prevented. Further, even if the peripheral surface of the guide roller comes in contact with the surface of the intermediate transferring belt, the guide roller is drivenly rotated by running of the intermediate transferring belt, so that abrasion of the belt can be reduced.

According to the present invention, a distance between the sheet and the surface of the intermediate transferring belt can be retained to be greater than a predetermined distance regardless of changes in a state of conveying the sheet and largeness of flexure on a rotational path of the intermediate transferring belt. Accordingly, rubbing of a sheet with respect to toner image formed on the intermediate transferring belt before the secondary transfer and dispersing of the toner image on the belt to the sheet are prevented, so that a stable and high-quality image can be transferred onto the sheet.

This application is based on Japanese Patent Application Serial No. 2007-066374 filed in Japan Patent Office on Mar. 15, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

an image forming unit for forming a toner image by developing a latent image formed on an image bearing member with toners;

an intermediate transferring belt which runs in a state where the toner image formed by the image forming unit is transferred onto a surface of the intermediate transferring belt, the intermediate transferring belt defining a loop extending around a driving roller and a tension roller spaced from the driving roller;

a transferring roller arranged close to the surface of the intermediate transferring belt and opposed to the driving roller so that the intermediate transferring belt is disposed between the transferring roller and the driving roller;

a sheet conveying section for conveying a sheet through a conveying path along the surface of the intermediate transferring belt and allowing the toner image to transfer onto a transfer surface of the sheet through a nip portion formed between the intermediate transferring belt and the transferring roller; and a clearance retaining section disposed for guiding the sheet along a conveying surface provided at an upstream position of the transfer nip portion in the conveying path and retaining a clearance between the conveying surface and the intermediate transferring belt to be greater than a predetermined clearance, the clearance retaining section being substantially aligned with an unsupported portion of the intermediate transferring belt between the driving roller and the tension roller for maintaining at least the predetermined clearance despite flexural oscillation of the unsupported portion of the intermediate transferring belt.

2. The image forming apparatus according to claim 1, wherein the clearance retaining section is provided on an outer side of a sheet passing area in a width direction of the conveying path, and has a projection which projects from the conveying surface toward a surface of the intermediate transferring belt, and retains the clearance between the conveying surface and the surface of the intermediate transferring belt to be greater than the predetermined clearance.

3. The image forming apparatus according to claim 1, wherein:

the clearance retaining section includes a guide member provided at an upstream position of the transfer nip portion in a sheet conveying direction and adapted to guide the sheet along the conveying surface extending in a width direction of the conveying path at the upstream position of the transfer nip portion, the guide member is integrally formed with at least one projection projecting toward a surface of the intermediate transferring belt from the conveying surface at a position outer than a sheet passing area on the conveying surface, and the guide member retains the clearance between the conveying surface and the surface of the intermediate transferring belt to be greater than the predetermined clearance via said projection.

4. The image forming apparatus according to claim 3, wherein the at least one projection comprises two projections formed respectively on each of opposite ends in the width direction of the guide member.

5. The image forming apparatus according to claim 3, wherein a supporting portion is provided in the conveying path, and an attaching and detaching structure for detachably supporting the guide member with respect to the supporting portion is provided.

6. The image forming apparatus according to claim 1, wherein the clearance retaining section includes a guide roller provided on an outer side of a passing area of the sheet in a width direction of the conveying path and rotatably supported at a position closer to the surface of the intermediate transferring belt than the conveying path, and the guide roller retains a clearance between the conveying surface and the surface of the intermediate transferring belt to be greater than a predetermined clearance.

* * * * *